United States Patent [19]

Rogan et al.

[11] 4,136,047

[45] Jan. 23, 1979

[54] VISCOSITY INDEX IMPROVERS

[75] Inventors: John B. Rogan, Glen Ellyn, Ill.; Steven A. White, San Francisco, Calif.

[73] Assignee: Standard Oil Company (Indiana), Chicago, Ill.

[21] Appl. No.: 849,607

[22] Filed: Nov. 8, 1977

Related U.S. Application Data

[63] Continuation of Ser. No. 615,606, Sep. 22, 1975, abandoned.

[51] Int. Cl.[2] ..... C10M 1/24

[52] U.S. Cl. ..... 252/56 R; 252/59; 260/874; 260/875; 260/885; 260/886

[58] Field of Search ..... 252/56 R, 59; 260/874, 260/875, 885, 886

[56] References Cited

U.S. PATENT DOCUMENTS

| | | | |
|---|---|---|---|
| 2,721,877 | 10/1955 | Popkin et al. | 252/56 R X |
| 2,721,878 | 10/1955 | Popkin | 252/56 R X |
| 2,721,879 | 10/1955 | Popkin et al. | 252/56 R X |
| 2,810,744 | 10/1957 | Popkin | 252/56 R X |
| 2,965,571 | 12/1960 | Wuellner et al. | 252/56 R X |
| 3,186,974 | 6/1965 | Verberg | 252/56 R X |
| 3,318,813 | 5/1967 | McCormick et al. | 252/59 |
| 3,676,190 | 7/1972 | Landler et al. | 260/885 X |
| 3,903,023 | 9/1975 | Boutillier | 260/874 X |

*Primary Examiner*—Delbert E. Gantz
*Assistant Examiner*—Andrew Metz
*Attorney, Agent, or Firm*—Wallace L. Oliver; Arthur G. Gilkes; William T. McClain

[57] ABSTRACT

Block copolymers containing styrene, alpha-methylstyrene, 3,4-dimethyl-alpha-methylstyrene and lauryl methacrylate are useful as viscosity index improvers in lubricating oils.

19 Claims, 2 Drawing Figures

SONIC SHEAR STABILITY

VISCOSITY INDEX IMPROVERS

Figure 1:
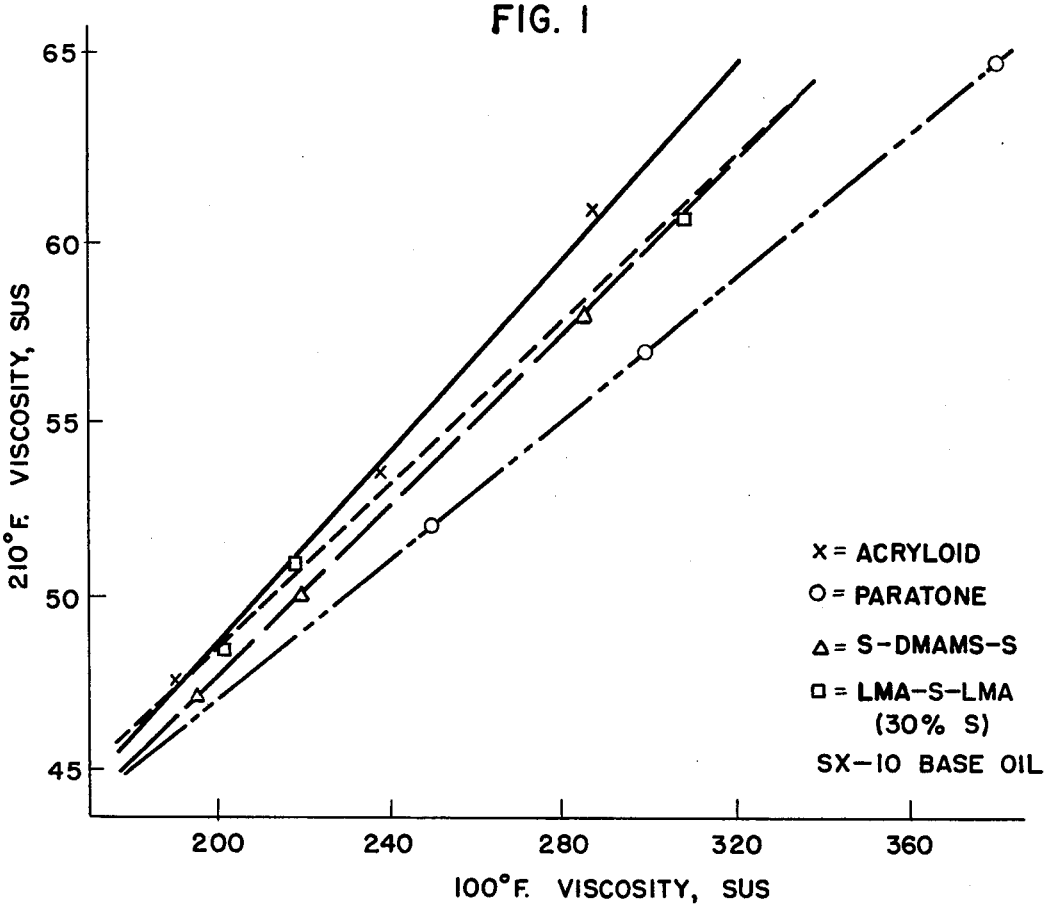

This is a continuation of application Ser. No. 615,606, filed Sept. 22, 1975, now abandoned.

BACKGROUND OF THE DISCLOSURE

This invention relates to viscosity index improvers and more specifically relates to the use of block copolymers containing styrene, alpha-methylstyrene (AMS), 3,4-dimethyl-alpha-methylstyrene (DMAMS) and lauryl methacrylate (LMA) for such purposes.

The need and uses of lubricant additives are described by Larson and Larson in Chapter 14 of the *Standard Handbook of Lubrication Engineering,* (1968), which is incorporated herein by reference. A major factor in selecting a particular lubricant system for a specific application is the lubricant's viscosity variation with temperature. This viscosity-temperature variation, designated as the viscosity index (VI) scale, is described in the ASTM test D2270 which rates the VI of an oil by measuring its viscosity at 100° and 210° F., and basing the index on assigned values of standard 0 and 100 VI oils. It is known that the variation in viscosity can be determined with considerable accuracy from the viscosity measurements at these two temperatures.

VI improvers are combined with oils which cannot be refined practically to a desired VI or in oils which encounter wide temperature variations such as those used in crank cases of internal combustion engines, hydraulic systems, automatic transmissions, gear cases, and air compressors. Depending on the properties of the base oil, VI values greater than 100 can be achieved most easily and economically by the use of VI improvers.

The two principal types of VI improvers commercially available are polymers of isobutylene (e.g., Exxon's Paratone) and acrylate polymers, and copolymers such as poly(lauryl methacrylate), and random copolymers of lauryl and butyl methacrylate (e.g., Rohm and Haas' Acryloid). In these additives, the molecular weight is controlled to achieve a balance between VI improver effectiveness and shear stability. This is done because, although high molecular weight polymers give high VI improvement per unit of material added, higher molecular weight polymers are increasingly subject to breakdown under high shearing conditions found in high-speed, rotating engine parts, high-speed gear cases, hydraulic systems and the like. Block copolymers containing hydrogenated blocks of isoprene and blocks of a vinyl aromatic which also may be hydrogenated are described in U.S. Pat. Nos. 3,763,044 and 3,775,329 incorporated herein by reference. These copolymers suffer from the relative costly hydrogenation procedure which must be employed in their manufacture.

The object of our invention is to provide a polymeric composition which can be used as a viscosity index improver with high shear stability. Another object is to provide a lubricant system which possesses a high viscosity index. Still another object is to provide an improved lubricant system at low cost. Other objects appear hereafter.

SUMMARY OF THE INVENTION

Our invention comprises block copolymers having molecular weights ranging from about 10,000 to 500,000 and having a weight average molecular weight to number average molecular weight ($\overline{M}w/\overline{M}n$) ratio less than 2, which comprises (a) from about 5 to 50 wt. % in blocks of styrene or alpha-methylstyrene, and (b) from about 50 to 95 wt. % in blocks of 3, 4-dimethyl-alpha-methylstyrene or lauryl methacrylate, which can be incorporated into a lubricating composition in effective amounts to improve its viscosity index.

BRIEF DESCRIPTION OF THE INVENTION

The effectiveness of a VI improver as measured by the slope of the 100° F. vs. 210° F. viscosity line is the increase in 210° F. viscosity per unit increase in 100° F. viscosity. If, in order to achieve a certain 210° F. viscosity, addition of a VI improver substantially increases the 100° F. viscosity, the low temperature (0° F.) viscosity can exceed an acceptable level. In one model to explain the effect on viscosity as a function of polymer structure, a polymer molecule becomes more or less coiled as a function of polymer-solvent interactions. A tightly coiled polymer molecule in a poor solvent will increase viscosity of the solution a relatively small amount, while a well-solvated uncoiled molecule will increase viscosity a relatively large amount. Thus, an optimum VI polymer is one for which oil is a relatively poor solvent at lower temperatures and a better solvent at elevated temperatures.

We have found that block copolymers containing at least one oil insoluble block of styrene or AMS (hereinafter "A" block) and an oil soluble block of DMAMS or LMA (hereinafter "B" block) are useful as VI improvers being superior shear properties at a low cost. These copolymers show the hydrolylic and oxidative stability required for VI improvers. Further, these resins are soluble in base oil in the ranges necessary to impart VI improvement characteristics. Useful block copolymers of our invention have a total molecular weight ranging from about 10,000 to 500,000 and preferably from about 100,000 to 300,000. Such copolymers can either be A-B, A-B-A or B-A-B copolymers. The amount of the "A" block in such polymer can range from about 5 to 50% by weight and preferably from about 10 to 30%.

The amount of copolymer of this invention required in a lubricating composition in order to yield effective viscosity index improvement over the base oil depends on the specific copolymer, base oil and other additives used. An effective amount of copolymer typically ranges from about 0.1 to 10 wt.%, preferably from about 0.5 to 5 wt. % and optimumly about 1 wt.% in the resulting lubricating composition.

The preferred base oil is a mineral lubricating oil typically prepared from crude oil by usual processes such as distillation, extraction, deasphalting, dewaxing, hydrofining, polymerization and the like. Examples of such base oil are SAE-SX-5 and SAE-SX-10 oils. Our lubricant composition also can contain various other additives such as antioxidants, detergents and pour point depressants.

Linear block copolymers having a narrow molecular weight distribution ($\overline{M}w/\overline{M}n$ ratio less than 2 and preferably less than 1.5, as determined by gel permeation chromatography (CPC)) are preferred in order to achieve high sonic shear stabilities. Such polymers can be prepared by anionic polymerization techniques which are described more fully by L. Reich et al., Polymer Reviews, Vol. 12, p. 699 et seq. (1966); M. Szware, "Carbanions, Living Polymers and Electron Transfer Processes", Interscience, New York, 1968; J. W. Breitenbach et al., Kollidiz, Vol. 182, p. 35 et seq. (1962); J. T. Bailey et al., Rubber Age, Vol. 98, p. 69 et seq. (1966) and A. W. Van Breen et al., Rubber and Plastics Age, Vol. 47, p. 1070 et seq. (1966), all of which are incorporated by reference herein. Suitable initiators include sodium naphthalene, AMS tetramer dianion, sodium biphenyl and lithium alkyls. Depending on the initiator, either a 2-block or 3-block copolymer can be formed. For example, using n-butyl lithium yields and A-B copolymer while a sodium naphthalene initiator produces a 3-block copolymer. The total molecular weight of our copolymers is controlled by the ratio of combined monomers to the initiator while the block length of each portion is controlled by the ratio of the individual monomers. In a 3-block copolymer, the order in which the monomers are introduced into the polymerization reaction determines whether an A-B-A or B-A-B copolymer is formed.

EXPERIMENTAL PROCEDURES

In all operations where the absence of water and air was important, the glassware was dried in a 170° C. oven for at least 30 minutes and then allowed to cool in a stream or argon. The use of "dried" will be understood to mean this procedure. Tetrahydrofuran (THF) was distilled from excess sodium naphthalene under an argon atmosphere into a dried 3000 milliliter flask or bottle. Subsequently, this bottle was fitted with a dried dispenser assembly which permited the THF to be forced under argon pressure directly into the reaction flask. Sodium naphthalene was prepared in THF solution as described by Sorenson and Campbell, "Preparative Methods of Polymer Chemistry," Interscience Publishers, Inc., New York, 1961, at page 197, and was transferred under argon pressure through 1-2mm I.D. polyethylene tubing to a dried flask fitted with a stopcock. Samples of solution were withdrawn conveniently through the stopcock with a syringe. The concentration of sodium naphthalene was determined by titration of aliquots with standard HCl using methyl red as the indicator. Shortly before use, all monomers were passed through a four-inch bed of activated silica gel and stored under argon.

Polymerizations were carried out in three-neck flasks fitted with a stirrer in a ground joint bearing and an opening that was just large enough for a serum cap. Argon gas inlet and outlets were through syringe needles that pierced the serum cap. Although the dried equipment was assembled while hot, the THF solvent was added after cooling in an argon stream. All subsequent additions of catalyst or monomer were made with dried syringes and needles. Impurities in the THF were "titrated away" with sodium naphthalene and then the calculated quantity of sodium naphthalene was added to give the desired molecular weight. The reaction flask was cooled to approximately −40° C. internal flask temperature in a dry ice bath and the monomer then added as rapidly as possible with a syringe. While styrene polymerized immediately, AMS and DMAMS required approximately one hour while reaction mixture was cooled to −78° C. After initial polymerization either a second monomer was added or the reaction was quenched with methanol. With LMA as the second monomer enough 1,1-diphenylethylene was added to cap all anionic ends before adding the LMA. Polymers were isolated by precipitation in methanol or isopropyl alcohol, filtration and resuspension in fresh methanol in a Waring Blender, filtering again and drying. Yields were usually quantitative.

A series of block copolymers of styrene, DMAMS and LMA were prepared using standard experimental procedures with nearly constant total molecular weight of about 200,000 but with varying composition. The $\overline{M}w/\overline{M}n$ ratio for the block copolymers was less than 1.5 as determined by GPC. For these polymers, the "inside" block was formed first by polymerization of the appropriate monomer and then the monomer for the "outside" block added. As was true of all alpha-substituted styrenes, it was necessary to polymerize the DMAMS at low temperatures (−78 to −40° C.) due to its low ceiling temperature. To prepare a block copolymer with styrene "inside", it is possible to use a mixture of the monomers due to the large difference in reactivity ratios. In contrast, block copolymers of methacrylates and styrene can be prepared only with styrene "inside," because the polystyryl anion will initiate methacrylate polymerization but the methacrylate anion will not initiate a styrene polymerization. The widely different acidities of the alpha-hydrogens of esters and ethylbenzene point to the same conclusion. The relative acidity of two compounds is a measure of the relative stabilities of their conjugate bases. Since esters are approximately ten powers of ten more acidic than ethylbenzene, it follows that the methacrylate ion is more stable than the polystyryl ion and, thus, the ability of one anion to initiate polymerization of the other monomer is understandable. When lauryl methacrylate was added to polystyryl dianion directly, there was only a low yield of block copolymer produced. This was attributed to attack of the anion at the carbonyl carbon of LMA, thus, terminating the chain rather than at the carbon as desired. This reaction was avoided by first adding one mole of 1,1-diphenylethylene for each anion equivalent of the polystyryl dianion. The resulting anion is less reactive and more discriminating so that it attacks LMA only at the beta carbon.

Figure 2:
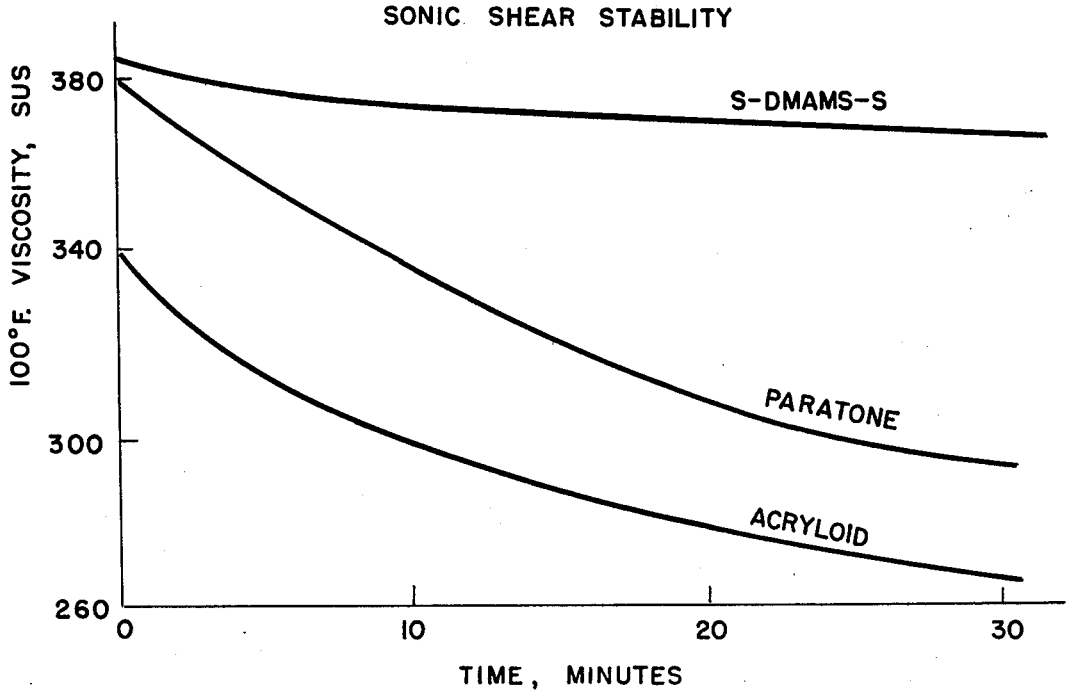

A series of copolymers were tested as viscosity index improvers and the results are shown in Table I and FIG. 1. The data show that a S-DMAMS-S block copolymer containing 12% styrene in SX-10 fuel oil is superior to Paratone and is comparable to Acryloid. Sonic shear stability data given in Table II and FIG. 2 show that the copolymer is superior to either Acryloid or Paratone.

TABLE I

| Polymer[1] (V.I. Improver) | Styrene in Polymer (wt.%) | Base Oil Typ | Concentration of Polymer in Base Oil (wt.%) | 100 ° F. Viscosity SUS | 210 ° F. Viscosity SUS | $VI_E$ |
|---|---|---|---|---|---|---|
| — | — | SX-5 | — | 89.7 | 38.4 | 92 |
| 13 | — | SX-10 | — | 175.0 | 44.6 | 95 |
| Acryloid | — | SX-5 | 0.6 | 126.0 | 44.5 | 169 |
| " | — | " | 1.0 | 153.0 | 49.1 | 198 |
| " | — | " | 1.4 | 186.0 | 55.3 | 225 |
| " | — | SX-10 | 0.2 | 190.0 | 47.6 | 123 |
| " | — | " | 0.6 | 238.0 | 53.6 | 152 |
| " | — | " | 1.0 | 287.0 | 60.7 | 179 |
| Paratone | — | SX-5 | 1.0 | 140.0 | 44.7 | 144 |
| " | — | " | 1.4 | 163.0 | 47.5 | 155 |
| " | — | " | 2.0 | 212.0 | 52.7 | 168 |
| " | — | SX-10 | 1.0 | 250.0 | 52.0 | 124 |
| " | — | " | 1.6 | 300.0 | 56.9 | 137 |
| " | — | " | 2.0 | 380.0 | 64.9 | 146 |
| LMA | — | SX-10 | 1.0 | 234.1 | 51.9 | 132 |
| " | — | " | 2.0 | 268.1 | 55.1 | 144 |
| " | — | " | 4.0 | 388 | 68.8 | 160 |
| DMAMS — | SX-5 | 0.5 | 98.2 | 39.5 | 106 | |
| " | — | " | 1.0 | 108.2 | 40.9 | 128 |
| " | — | " | 2.0 | 138.2 | 44.1 | 135 |
| S-DMAMS-S | 12 | SX-5 | 0.5 | 97.0 | 39.8 | 119 |
| " | 12 | " | 1.0 | 110.7 | 41.7 | 136 |
| " | 12 | " | 2.0 | 144.4 | 47.7 | 190 |
| S-DMAMS-S | 12 | SX-10 | 0.5 | 195.3 | 47.2 | 112 |
| " | 12 | " | 1.0 | 219.7 | 50.0 | 126 |

TABLE I-continued

| Polymer[1] (V.I. Improver) | Styrene in Polymer (wt.%) | Base Oil Typ | Concentration of Polymer in Base Oil (wt.%) | 100 °F. Viscosity SUS | 210 °F. Viscosity SUS | $VI_E$ |
|---|---|---|---|---|---|---|
| " | 12 | " | 2.0 | 285.2 | 57.9 | 152 |
| LMA-S-LMA | 20 | SX-10 | 0.5 | 234.9 | 50.7 | 121 |
| " | 20 | " | 1.0 | 330.5 | 61.4 | 147 |
| " | 20 | " | 2.0 | 615.0 | 101.0 | 190 |
| " | 20 | " | 4.0 | 2336. | 371.5 | 261 |
| LMA-S-LMA | 30 | SX-10 | 0.5 | 202.6 | 48.6 | 125 |
| " | 30 | " | 1.0 | 218. | 50.9 | 138 |
| " | 30 | " | 2.0 | 309. | 60.5 | 154 |
| LMA-S-LMA[2] | 40 | SX-10 | 0.5 | 203. | 47.7 | 112 |
| " | 40 | " | 1.0 | 240. | 51.6 | 127 |
| " | 40 | " | 2.0 | 349. | 64.6 | 157 |

[1]S = Styrene
DMAMS = 3,4-dimethyyl-alpha-methylstyrene
LMA = Lauryl methacrylate
2oil solution hazy

TABLE II

| TIME (minutes) | Viscosity, SUS[1] Paratone 100° F. | Paratone 210° F. | Acryloid 100° F. | Acryloid 210° F. | S-DMAMS-S 100° F. | S-DMAMS-S 210° F. |
|---|---|---|---|---|---|---|
| 0 | 382 | 68.6 | 343 | 66.7 | 386 | 66.4 |
| +10 | 340 | 62.8 | 299 | 59.8 | 376 | 65.7 |
| +20 | 320 | 60.4 | 281 | 57.6 | 373 | 65.6 |
| +30 | 306 | 58.8 | 270 | 56.2 | 371 | 64.9 |
| % Disintegration after 30 minutes | 19% | 14% | 21% | 16% | 4% | 2% |

[1]Lubricant composition = SX-10 base oil 89%
VI improver 2%
other additives 9%

We claim:

1. A lubricating composition comprising a base mineral oil and a viscosity index improving amount of a viscosity index improver comprising a block copolymer having two or three block segments, having a molecular weight ranging from about 12,000 to 500,000 and having an $\overline{M}w/\overline{M}n$ ratio less than 2, which comprises (a) from about 5 to 50 wt.% in blocks of styrene or alpha-methylstyrene, and (b) from about 50 to 95 wt.% in blocks of 3,4-dimethyl-alpha-methylstyrene.

2. the lubricating composition of claim 1 wherein the block copolymer has a molecular weight ranging from about 100,000 to 300,000.

3. The lubricating composition of claim 1 wherein the block copolymer contains from about 10 to 30 wt. % in blocks of styrene or alpha-methylstyrene.

4. The lubricating composition of claim 1 wherein the block copolymer has a $\overline{M}w/\overline{M}n$ ratio less than 1.5.

5. The lubricating composition of claim 1 wherein the effective amount of viscosity index improver ranges from about 0.5 to 5 wt. %.

6. The lubricating composition of claim 5 wherein the viscosity index improver commprises a block copolymer having three block segments having a molecular weight ranging from about 100,000 to 300,000 and having a $\overline{M}w/\overline{M}n$ ratio less than 1.5, which comprises from about 10 to 30 wt. % in outer blocks of styrene and (b) from about 70 to 90 wt. % in an inner block of 3,4-dimethyl-alpha-methylstyrene.

7. The lubricating composition of claim 6 wherein the block copolymer has a molecular weight of about 200,000 and which contains about 12 wt. % styrene.

8. A method for improving the viscosity index of a lubricating composition comprising a base mineral oil, comprising adding to the composition an effective amount ranging from about 0.1 to 10 wt.% of a block copolymer having two or three block segments, having a molecular weight ranging from about 10,000 to 500,000 and having an $\overline{M}w/\overline{M}n$ ratio less than 2, which comprises (a) from about 5 to 50 wt.% in blocks of styrene or alpha-methylstyrene, and (b) from about 50 to 95 wt.% in blocks of 3,4-dimethyl-alpha-methylstyrene, such that the viscosity index of the composition is improved.

9. The method of claim 8 wherein the viscosity index improver comprises a block copolymer having three block segments having a molecular weight ranging from about 100,000 to 300,000 and having a $\overline{M}w/\overline{M}n$ ratio less than 1.5, which contains from about 10 to 30 wt. % in styrene or alpha-methylstyrene.

10. The method of claim 9 wherein the block copolymer contains outer blocks of styrene and an inner block of 3,4-dimethyl-alpha-methylstyrene.

11. A block copolymer having a molecular weight ranging from about 10,000 to 500,000 and having a $\overline{M}w/\overline{M}n$ ratio less than 2.0, which comprises (a) from about 5 to 50 wt. % in blocks of styrene or alpha-methylstyrene and (b) from about 50 to 95% in blocks of 3,4-dimethyl-alpha-methylstyrene.

12. The block copolymer of claim 11 having three block segments which contains outer blocks of styrene and an inner block of 3,4-dimethyl-alpha-methylstyrene.

13. A lubricating composition comprising a base mineral oil and a viscosity index improving amount of a viscosity index improver comprising a block copolymer having two or three block segments having a molecular weight ranging from about 10,000 to 500,000 and having an $\overline{M}w/\overline{M}n$ ratio less than 2, which comprises (a) from about 5 to 50 wt.% in blocks of styrene or alpha-methylstyrene and (b) from about 50 to 95 wt.% in blocks of lauryl methacrylate.

14. The lubricating composition of claim 13 wherein the viscosity index improver comprises a block copolymer having a molecular weight ranging from about 10,000 to 300,000 and having an $\overline{M}w/\overline{M}n$ ratio less than 1.5, which comprises (a) from about 10 to 30 wt.% in an inner block block of styrene and (b) from about 70 to 90 wt.% in outer blocks of lauryl methacrylate.

15. The lubricating composition of claim 13 wherein the block copolymer has a molecular weight of about 200,000.

16. A method for improving the viscosity index of a lubricating composition comprising a base mineral oil comprising adding to the composition an effective amount ranging from about 0.1 to 10 wt. % of a block copolymer having two or three block segments, having a molecular weight ranging from about 10,000 to 500,000 and having an $\overline{M}w/\overline{M}n$ ratio less than 2, which comprises (a) from about 5 to 50 wt.% in blocks of styrene or alpha-methylstyrene, and (b) from about 50 to 95 wt.% in blocks of lauryl methacrylate, such that the viscosity index of the composition is improved.

17. The method of claim 16 wherein the block copolymer contains an inner block of styrene and outer blocks of lauryl methacrylate.

18. A block copolymer having two or three block segments, having a molecular weight ranging from about 10,000 to 500,000 and having an $\overline{M}w/\overline{M}n$ ratio less than 2.0, which comprises (a) from about 5 to 50 wt.% in blocks of styrene or alpha-methylstyrene and (b) from about 50 to 95 wt. % in blocks of lauryl methacrylate.

19. The block copolymer of claim 18 having three block segments which contain an inner block of styrene and outer blocks of lauryl methacrylate.

* * * * *

UNITED STATES PATENT OFFICE

CERTIFICATE OF CORRECTION

Patent No. 4,136,047 Dated January 23, 1979

Inventor(s) Rogan - White

It is certified that error appears in the above-identified patent and that said Letters Patent are hereby corrected as shown below:

In Column 2, Line 59, "(CPC)" should read --(GPC)--

In Column 2, Line 63, "Szware" should read --Szwarc--.

In Column 3, Line 21, "or argon" should read --of argon--.

In Column 4, Line 49, "Typ" should read --Type--.

In Column 4, Line 50, "13" should read -- — --.

In Column 4, Line 62, the 18th line of Table I should read:

--DMAMS — SX-5 0.5 98.2 39.5 106 --

In Column 5, Line 18, "3,4-dimethyyl-" should read

--3,4-dimethyl- --

In Column 5, Line 44 "the" should read --The--.

UNITED STATES PATENT OFFICE

CERTIFICATE OF CORRECTION

Patent No. 4,136,047 Dated January 23, 1979

Inventor(s) Rogan - White

It is certified that error appears in the above-identified patent and that said Letters Patent are hereby corrected as shown below:

In Column 6, Line 53, "copolymer having a" should read --copolymer having three block segments having a--

In Column 6, Line 54, "10,000" should read --100,000--.

In Column 6, Line 58, "claim 13" should read --claim 14--.

Signed and Sealed this

Sixth Day of November 1979

[SEAL]

Attest:

RUTH C. MASON
*Attesting Officer*

LUTRELLE F. PARKER
*Acting Commissioner of Patents and Trademarks*